US005409196A

United States Patent [19]

Specht

[11] Patent Number: 5,409,196

[45] Date of Patent: Apr. 25, 1995

[54] SELF-TENSIONING FENCING SYSTEM

[75] Inventor: Paul Specht, Wilmette, Ill.

[73] Assignee: The Tensar Corporation, Atlanta, Ga.

[21] Appl. No.: 105,925

[22] Filed: Aug. 13, 1993

[51] Int. Cl.[6] ..... E04H 17/00

[52] U.S. Cl. ..... 256/54; 256/19; 256/45; 256/47

[58] Field of Search ..... 256/54, 19, 45, 56, 256/50, 47, 32, 13.1, 55, 48; 404/13, 9, 10

[56] References Cited

U.S. PATENT DOCUMENTS

| | | | |
|---|---|---|---|
| 1,122,829 | 12/1914 | Wernimont | 256/54 |
| 1,625,716 | 4/1927 | Edwards | 256/47 |
| 1,927,303 | 9/1933 | Benedict | 256/13.1 |
| 3,173,661 | 3/1965 | Kruger | 256/47 |
| 4,249,357 | 2/1981 | Cornou | 404/9 |
| 4,374,798 | 2/1983 | Mercer . | |
| 5,201,497 | 4/1993 | Williams | 256/45 |

FOREIGN PATENT DOCUMENTS

| | | | |
|---|---|---|---|
| 3631553 | 3/1988 | Germany | 404/9 |

*Primary Examiner*—Eric K. Nicholson
*Assistant Examiner*—Anthony Knight
*Attorney, Agent, or Firm*—Jacobson, Price, Holman & Stern

[57] ABSTRACT

A self-tensioning fencing system includes a mounting batten, made of plastic or metal, which is mounted directly to a structural support such as a fence post using standard nails, screws or bolts as required according to the type of a particular fence post. The mounting batten may be a solid or a thick walled hollow section elastic extrusion or a metal form. The mounting batten is secured to the structural support post so as to space the plastic grid material away from the support post to allow the plastic grid material to be tensioned at a spacing from the structural support posts. A channel batten made of pre-coated cold rolled steel mounts over the plastic batten and serves to clamp plastic grid fencing material between the mounting batten, and the channel batten. The channel batten when drawn tight against the mounting batten serves not only to firmly attach the fencing material to the support post but acts as a tensioning device. The amount of tensioning take-up provided by the channel batten is dependent upon the respective cross-sectional dimensions of the mounting batten and the channel batten. In a typical application, the tensioning capability of the channel batten is in the range of $\frac{3}{8}$ of an inch to $\frac{7}{8}$ of an inch at each support post, and preferably $\frac{5}{8}$ of an inch, dependent upon the plastic grid material used and the size and shape of the mounting batten and the channel batten.

11 Claims, 4 Drawing Sheets

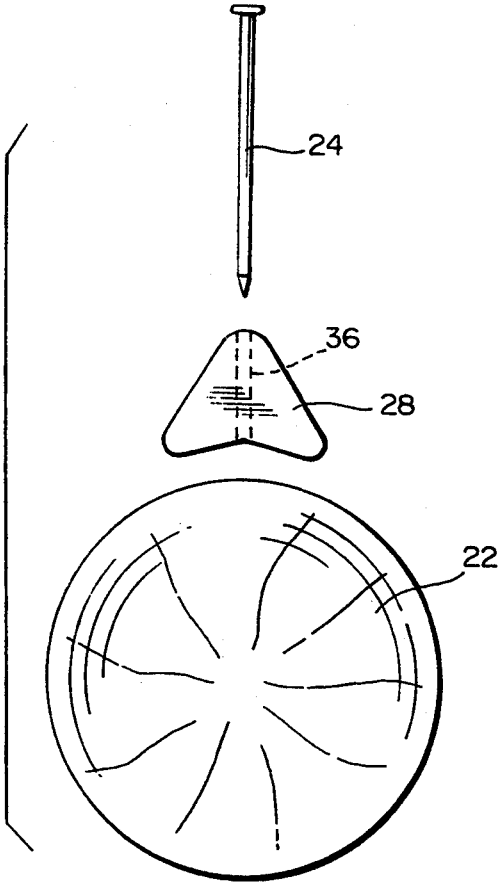
FIG.5
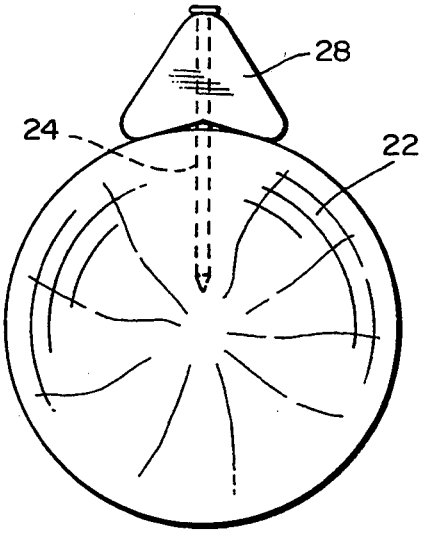
FIG.6
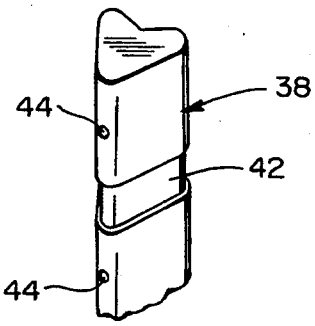
FIG.7
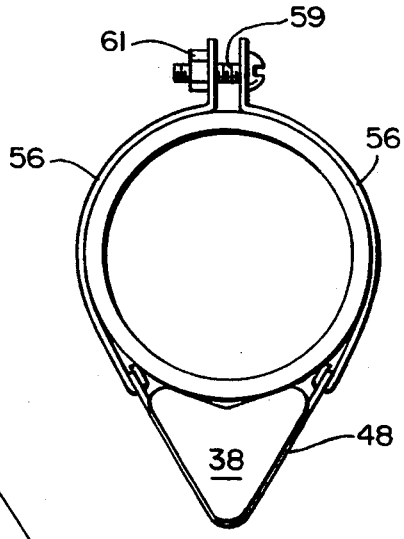
FIG.8
FIG.9
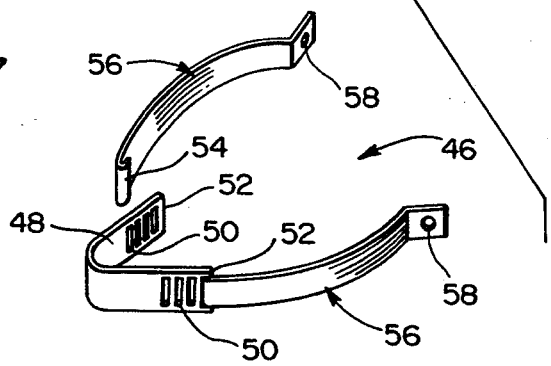

SELF-TENSIONING FENCING SYSTEM

FIELD OF THE INVENTION

The present invention includes a self-tensioning fencing installation system for plastic fencing material, such as uniaxial and biaxial grid material, knitted mesh and net materials, and even sheet plastic materials.

BACKGROUND OF THE INVENTION

Present fencing systems require erection of structural support posts at some predetermined spacing after which a roll of plastic fencing material is secured at one end to a post and then tensioned from a structural support post at an opposite end so as to stretch the plastic fencing material across the plurality of structural support posts. After stretching, the plastic fencing material is secured to the intermediary structural support posts.

SUMMARY OF THE INVENTION

By the present invention, it is now possible to tension a plastic grid material or any plastic fencing material across a plurality of structural support posts without the need for full tensioning of the entire length of the plastic grid material prior to the plastic grid material being secured to the structural support posts. To achieve this goal, a fastening system is used which is universally adaptable to both existing and new structural support posts of all common types such as wood, steel tube and rolled steel sections. A simple installation method is used to tension the plastic grid material without the need for specialized equipment after only a manual pre-tensioning of the plastic fencing material.

The self-tensioning fencing system of the present invention includes a mounting batten, made of plastic or metal, which is mounted directly to a structural support such as a fence post using standard nails, screws or bolts as required according to the type of a particular fence post. Alternatively, the mounting batten can be produced integral with a support post. The mounting batten may be a solid or a thick walled hollow section plastic extrusion or a metal form. The mounting batten is secured to the structural support post so as to space the plastic grid material away from the support post to allow the plastic grid material to be tensioned at a spacing from the structural support posts.

A channel batten may be made of pre-coated cold rolled steel or rigid plastic and be mounted over the mounting batten and serves to clamp plastic fencing material between the mounting batten and the channel batten. The channel batten when drawn tight against the mounting batten, serves not only to firmly attach the fencing material to the support post but acts as a tensioning device.

The amount of tensioning take-up provided by the channel batten is dependent upon the respective cross-sectional dimensions of the mounting batten and the channel batten. In a typical application, the tensioning capability of the channel batten is in the range of $\frac{3}{8}$ of an inch to $\frac{7}{8}$ of an inch at each support post, and preferably $\frac{5}{8}$ of an inch, which is variable dependent upon the plastic grid material used and the size and shape of the mounting batten and the channel batten. Advantageously, since full tension is not applied to the entire length of plastic fencing material until each channel batten is secured to a respective mounting batten, the present invention can accommodate a varying terrain.

It is therefore an object of the present invention to provide a simple self-tensioning fencing system for use with a plastic grid material.

It is another object of the present invention to adapt existing structural support posts to include a mounting batten over which is laid plastic grid material on top of which is secured a channel batten to the mounting batten so as to tension the interposed plastic grid material.

It is still yet another object of the present invention to tension extended lengths of plastic grid material across separated structural support posts by clamping a mounting batten to the post and thereafter securing a channel batten to the mounting batten by self-tapping metal screws with the plastic grid material interposed between the mounting batten and the channel batten.

It is still a further object of the present invention to tension extended lengths of plastic grid material across separated structural support posts by nailing a mounting batten to the posts and thereafter securing a channel batten to the mounting batten by nails with the plastic grid material interposed between the mounting batten and the channel batten.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 5 is an exploded view of a nail securing a mounting batten to a wooden support post.

FIG. 6 illustrates a mounting batten secured to a wooden support post.

FIG. 7 illustrates an exemplary mounting batten for use with a tubular support post.

FIG. 8 illustrates a mounting batten clamped to a tubular support post.

FIG. 9 is an exploded view of a clamp for securing a mounting batten to a tubular support post.

DETAILED DESCRIPTION OF THE PREFERRED EMBODIMENTS

Figure 1:
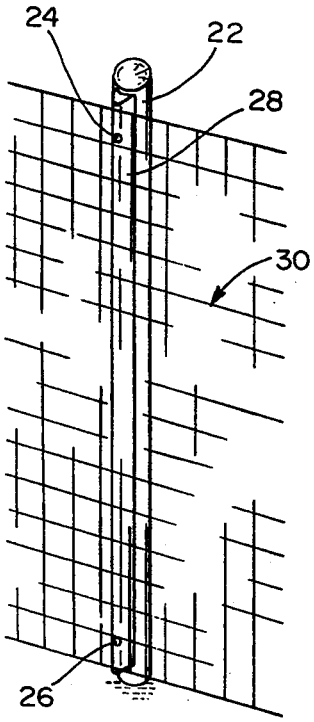
FIG. 1 is a schematic representation of a mounting batten secured to a structural support post with a length of plastic grid material extending across the post.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1–4, in particular, a self-tensioning fencing system involving the teachings of the subject invention is generally designated as 20. With reference to the orientation of the component elements of the self-tensioning fencing system, FIG. 1 illustrates a structural support post 22 which may be a wooden post, metal post, hollow or solid plastic or any other form of structural support post. In FIG. 1, a wooden support post 22 is shown.

Attached to the support post 22 by nails 24 and 26 is a mounting batten 28. The mounting batten 28 may be of solid or hollow construction, or V-shape, made of either metal or plastic material.

Figure 2:
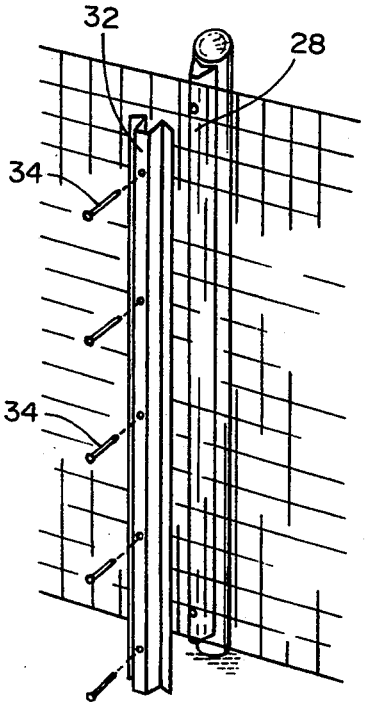
FIG. 2 is a schematic representation of an exploded view of a channel batten being secured to a structural support post having a mounting batten secured thereto with a length of plastic grid material extending across the post.
Figure 3:
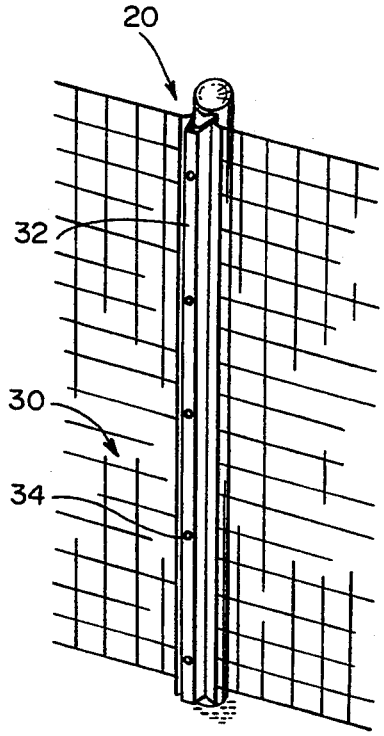
FIG. 3 is a schematic representation of a channel batten secured to a mounting batten on a structural support post with a length of plastic grid material interposed between the mounting batten and channel batten.

The function of the mounting batten is to space a plastic grid or fencing material 30 away from the support post 22 so that when a channel batten 32 as shown in FIG. 2, is secured to the mounting batten 28 by nails or screws 34 as shown in FIGS. 2 and 3, the sidewalls of the channel batten press the plastic grid material along the sidewalls of the triangular shaped mounting batten so as to impose a tension across the plastic grid material between successive adjacent support posts.

Figure 4:
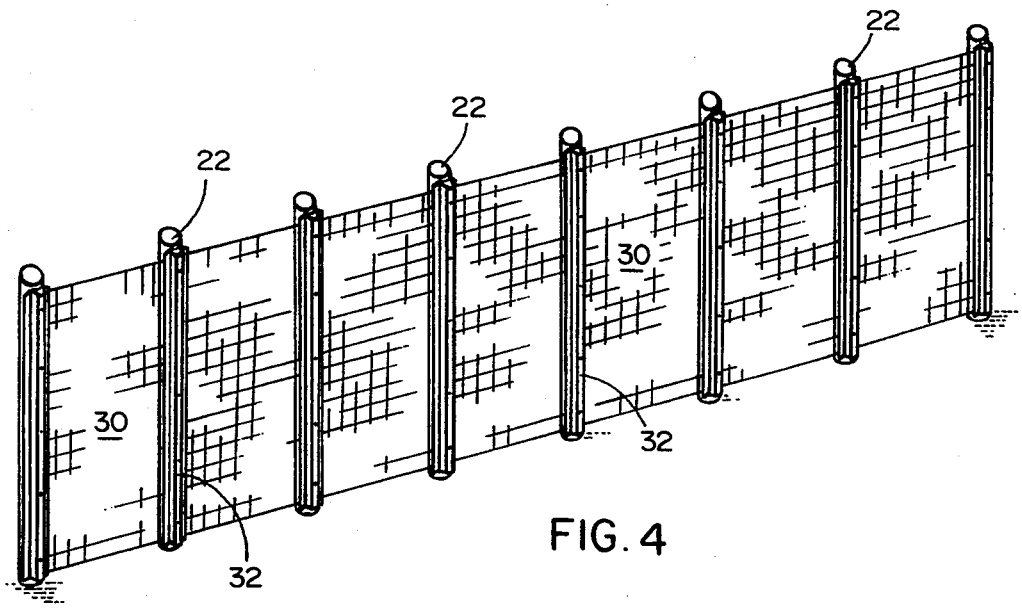
FIG. 4 schematically illustrates a length of plastic grid material secured to a plurality of structural support posts.

As shown in FIG. 4, for example, a 50′ length of 4′ wide plastic grid material, e.g., a grid material as may be produced by the process disclosed in U.S. Pat. No. 4,374,798, incorporated herein by reference, or any other plastic or other fencing material may be tensioned between a plurality of support posts 22 by a repeated application of channel battens 32 onto mounting battens 28 secured to the support posts 22. Initially, the plastic grid material is manually pre-tensioned to be somewhat taut with the final tensioning of the polymer grid material achieved by securing the channel batten to the mounting batten to successively adjacent support posts.

In FIGS. 5 and 6, installation of the mounting batten 28 to a wooden support post 22 is shown by driving a nail 24 through an opening 36, shown in dotted lines, in the mounting batten 28.

In FIGS. 7–9 an exemplary securing of a specialized mounting batten 38 is shown in conjunction with a hollow tubular support post 40. The batten 38 includes a plurality of recesses 42 spaced along the length of the batten 38 for receipt of a clamp so as to secure the batten 38 to the tubular post 40. In addition, openings 44 are spaced at four inch intervals along the length of the batten 38 starting at two inches from either end in the non-recessed areas of the batten for receipt of a screw to secure the channel batten to the mounting batten 38.

In FIG. 9, a typical clamp 46, used in conjunction with a tubular support post is shown as including a U-shaped band 48 having a plurality of openings 50 at its terminal ends 52, for receipt of hooks 54 located at one end of clamping bands 56. It is intended that the U-shaped band 48 surround the mounting batten 38, as shown in FIG. 8, and that the clamping bands 56 upon engaging in the openings 50 at the ends 52 of the U-shaped band 48 adjust the length of the clamp 46 to a length for surrounding the metal post 56. Holes 58 at the opposite ends from the hooks 54 of the clamping bands 56 are secured together by a bolt 59 and a nut 62 for tightening the mounting batten 38 to the tubular post 40.

Figure 12:
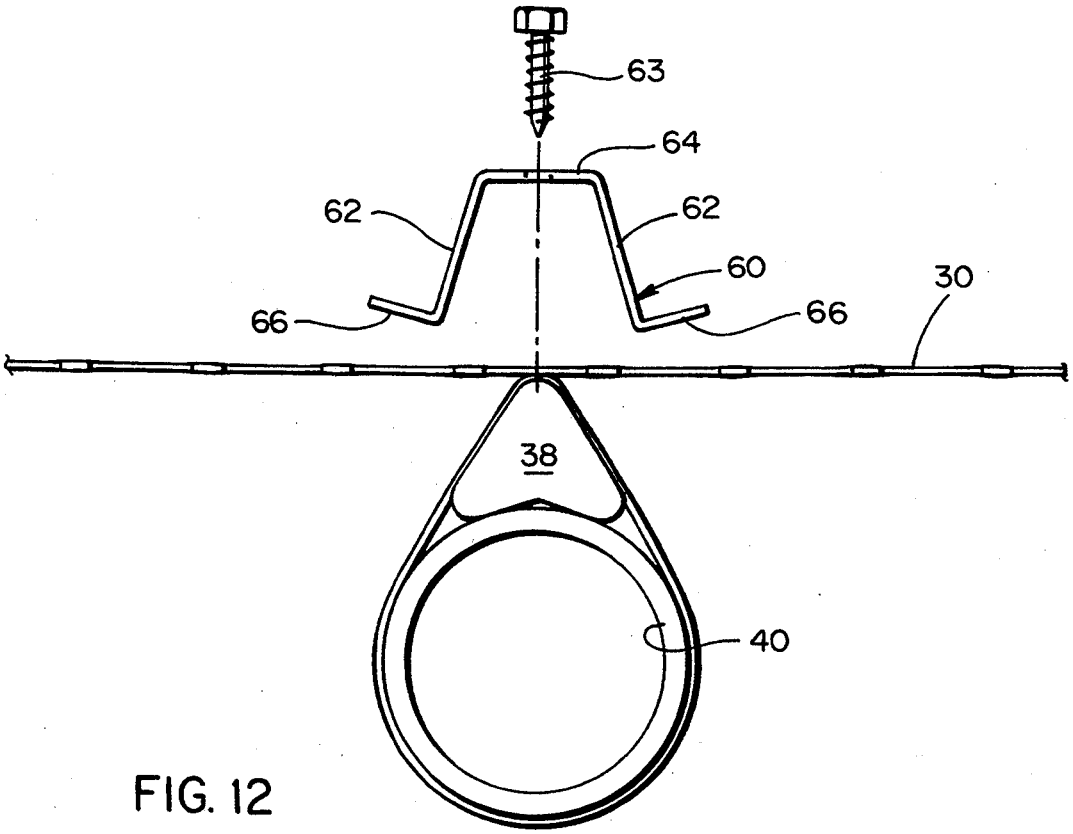
FIG. 12 is an exploded view of a channel batten being secured to a mounting batten with a length of plastic grid material extending between the channel batten and the mounting batten and the mounting batten being clamped to a tubular support post.
Figure 13:
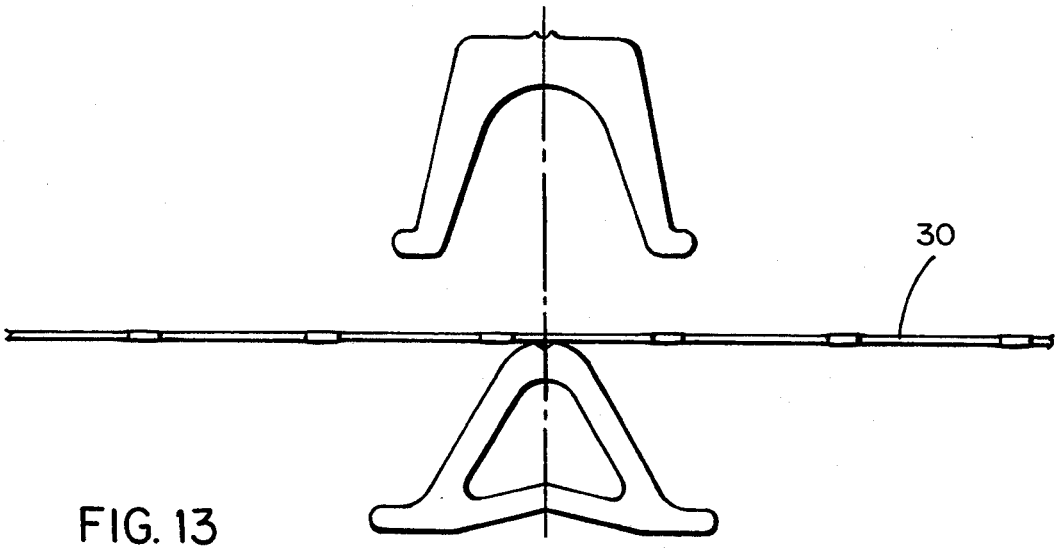
FIG. 13 is an exploded view of an extruded mounting batten and an extruded channel batten with a length of plastic grid material located between the channel batten and the mounting batten.

As shown in FIG. 12, a channel batten 60 is intended to be clamped onto the batten 38 by 3/16″ self tapping sheet metal screw 63 extending through the channel batten 60 and engaging in openings 44 of the batten 38. Channel batten 60 includes two diverging legs 62 interconnected by a cross-piece 64. Terminal ends 66 of the legs 62 are bent at an angle with respect to a major portion of the legs 62 so as to avoid cutting the plastic grid material 30 interposed between the channel batten and the mounting batten 38.

As will be explained in more detail with reference to FIGS. 10 and 11, the channel batten 60, secured to mounting batten 38 by screw 63, tensions the plastic grid material 30 between post 40 and the successive adjacent posts of the to be formed fence.

Figure 10:
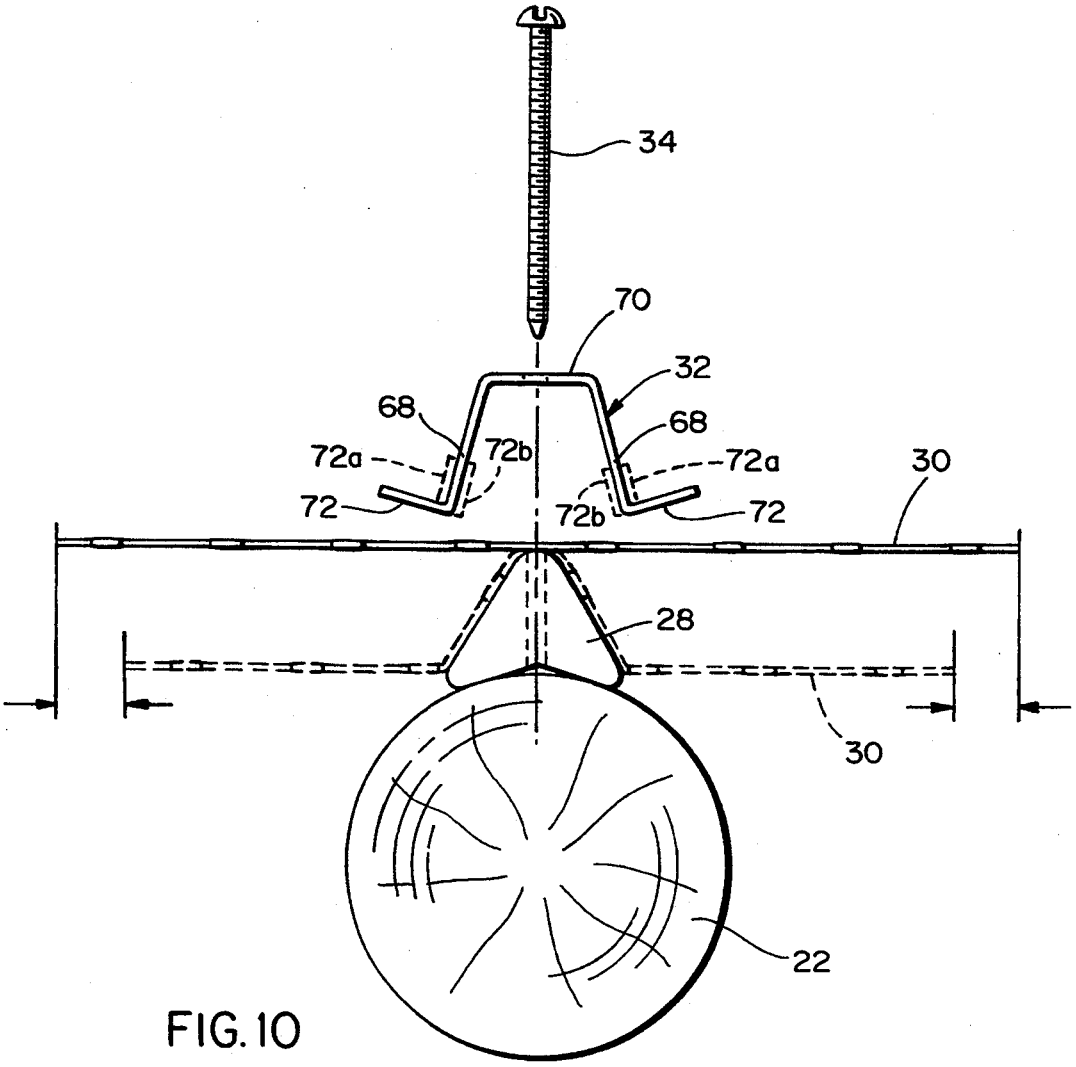
FIG. 10 is an exploded view of a channel batten being secured to a mounting batten so as to tension plastic grid material across the mounting batten.
Figure 11:
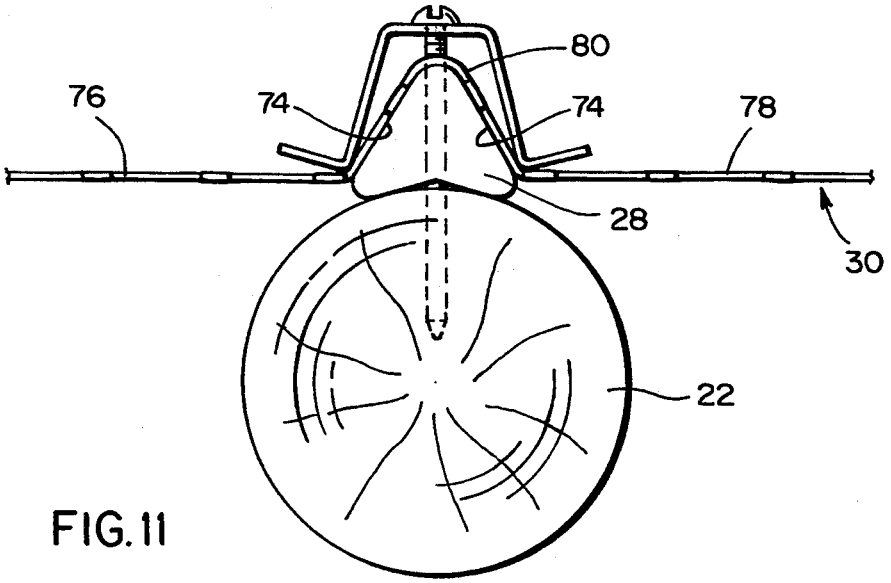
FIG. 11 illustrates a channel batten secured to a mounting batten with a length of plastic grid material interposed between the mounting batten and channel batten with the channel batten being secured to a wood post through the mounting batten.

In FIGS. 10 and 11, a mounting batten 28 is secured to wooden support post 22 by nails as is shown in FIG. 1. The channel batten 32 includes legs 68 interconnected by a cross-piece 70. The terminal portions 72 of the legs 68 are bent at an angle with respect to a major portion of the leg 68. The terminal portions 72 may actually be folded backwardly **72*a* or inwardly 72*b* onto the major portion of the leg 68, as shown in dotted lines in FIG. 10. The critical feature is that it is desired to prevent the channel batten from cutting through the plastic grid material 30 as the channel batten is secured to the wooden support post 22 by nail or screw 34**.

As shown in dotted lines in FIG. 10 and in solid lines in FIG. 11, when the channel batten is secured to the support post 22, the plastic grid material 30 is forced about the periphery of two sides 74 of the mounting batten 28. Therefore, between adjacent straight length sections 76 and 78 of plastic grid material 30, as shown in FIG. 11, is a peaked portion 80 of plastic grid material. This divergent peaked portion decreases the overall amount of grid material which can stretch between two adjacent support posts so as to tension the plastic grid material between adjacent support posts.

In FIG. 10, the plastic grid material 30 shown in solid lines is equal in length to the plastic grid material 30 shown in dotted lines. This demonstrates the take-up of plastic grid material by securing the channel batten to the mounting batten and the simultaneous tensioning of the plastic grid material.

Having described the invention, many modifications thereto will become apparent to those skilled in the art to which it pertains without deviation from the spirit of the invention as defined by the scope of the appended claims.

I claim:

1. A self-tensioned fence comprising:

a plurality of spaced support posts, each support post including a mounting batten and a channel batten secured to at least said mounting batten, said channel batten including two legs and a crosspiece interconnecting said two legs, terminal portions of said two legs being bent with respect to major portions of said two legs, and a length of plastic fencing material interposed between said mounting batten and said channel batten, said length of plastic fencing material being engaged by the bend between said terminal portions and said major portions of said two legs for preventing cutting of said plastic fencing material as said channel batten is secured to at least said mounting batten for supporting said plastic fencing material in a tensioned condition.

2. The self-tensioned fence of claim 1, wherein said mounting batten includes at least two divergent sides.

3. The self-tensioned fence of claim 2, wherein said mounting batten is clamped to each of said support posts.

4. The self-tensioned fence of claim 2 wherein said mounting batten is nailed or screwed to each of said support posts.

5. The self-tensioned fence of claim 1, wherein said terminal portions diverge from said major portions.

6. The self-tensioned fence of claim 1, wherein said terminal portions are bent inwardly and extend parallel to said major portions.

7. The self-tensioned fence of claim 1, wherein said mounting batten is integral with said support post.

8. A self-tensioning fencing system comprising:

support means for supporting an extended length of plastic fencing material in a tensioned condition, said support means including a mounting batten, a channel batten, means for securing said mounting batten to a structural support, and means for securing said channel batten to said mounting batten, said channel batten including two legs and a cross-piece interconnecting said two legs, terminal portions of said two legs being bent with respect to major portions of said two legs, said plastic fencing material being interposed between said mounting batten and said channel batten with said plastic fencing material being engaged by the bend between said terminal portions and said major portions of said two legs for preventing cutting of said plastic fencing material and to tension said plastic fencing material positioned therebetween.

9. The self-tensioning fencing system of claim 8, wherein said terminal portions diverge from said major portions.

10. The self-tensioning fencing system of claim 8, wherein said terminal portions are bent inwardly and extend parallel to said major portions.

11. The self-tensioning fencing system of claim 8, wherein said mounting batten includes at least two divergent sides.

* * * * *